United States Patent [19]

Hyre

[11] 4,239,480

[45] Dec. 16, 1980

[54] FLUID BED FURNACE AND PILOT LIGHT ASSEMBLY

[75] Inventor: Charles E. Hyre, Chesterton, Ind.

[73] Assignee: Fennell Corporation, Harvey, Ill.

[21] Appl. No.: 958,139

[22] Filed: Nov. 6, 1978

[51] Int. Cl.[3] ..... F23Q 3/00; F23D 19/02

[52] U.S. Cl. ..... 431/264; 431/7; 431/19; 431/43; 431/59; 431/170; 432/58; 110/245; 110/101 CB

[58] Field of Search ..... 431/7, 19, 43–46, 431/58, 59, 78, 170, 264, 266; 432/58; 122/4 D; 110/245, 263, 347, 101 CB

[56] References Cited

U.S. PATENT DOCUMENTS

| | | | |
|---|---|---|---|
| 2,627,308 | 2/1953 | Clark | 431/59 X |
| 2,688,363 | 9/1954 | Taricco | 431/43 |
| 2,698,655 | 1/1955 | Meredith | 431/78 X |
| 3,224,487 | 12/1965 | McInerney et al. | 431/36 X |
| 3,445,172 | 5/1969 | Zielinski | 431/78 X |
| 3,881,857 | 5/1975 | Hoy et al. | 431/7 |
| 3,884,617 | 5/1975 | Virr | 431/160 X |
| 3,903,846 | 9/1975 | Elliott et al. | 432/215 X |
| 4,017,253 | 4/1977 | Wielang et al. | 432/58 |
| 4,087,229 | 5/1978 | Teichert et al. | 431/43 |
| 4,184,456 | 1/1980 | Taylor et al. | 110/245 X |

FOREIGN PATENT DOCUMENTS 2215838 10/1972 Fed. Rep. of Germany ..... 431/170

*Primary Examiner*—Robert S. Ward, Jr.
*Attorney, Agent, or Firm*—Trexler, Wolters, Bushnell & Fosse, Ltd.

[57] ABSTRACT

An improved fluid bed furnace which includes a new and improved pilot light assembly and which is of the type having a fluid bed comprising material which fluidizes upon being subjected to a flow of gas mixture therethrough and a burner for burning a fuel mixture for providing the flow of gas mixture at an elevated temperature through the fluid bed material for fluidizing and agitating the fluid bed material. The pilot light assembly includes an ignition means for providing a pilot flame, pilot flame confining means for directing the pilot flame into the furnace fluid bed above the fluidizable material for causing the pilot flame to ignite the burner fuel mixture, and pilot flame detecting means for sensing the presence of the pilot flame and enabling the supply of the fuel mixture to the burner.

3 Claims, 4 Drawing Figures

FLUID BED FURNACE AND PILOT LIGHT ASSEMBLY

BACKGROUND OF THE INVENTION

The present invention is directed generally to an improved fluid bed furnace and more particularly to a new and improved pilot light assembly for use in a fluid bed furnace.

Furnaces for heat-treating metal components or the like are well known. Such furnaces have included a heated bath taking the form of molten salt or lead. The molten salt or lead is heated to an elevated temperature and the metal components to be treated are emersed therein, whereupon, the heat of the baths is transferred to the metal components for treatment.

Such furnaces, while being generally successful in heat-treating metal components or the like, have exhibited certain difficulties. For example, molten salt is hazardous when employed because it is potentially explosive should water come into contact with the heated salt. The salt may be heated to a temperature of, for example, 1400°-2000° F., which, upon contacting water, will explode. Hence, a great deal of care is necessary when employing such a furnace to make sure that water does not come into contact with the molten salt.

In the case of molten lead baths, molten lead is extremely acidic in nature, and hence, it is difficult to use in terms of finding a suitable container in which to contain the molten lead. Furthermore, molten lead and salt are wetting materials which, as a result, wet the metallic component being heat treated. As a result, some means must be provided for removing the molten lead or salt bath materials from the components subsequent to being treated.

In view of the foregoing, a furnace for heat-treating metal components or the like has been proposed which does not include salt or lead baths. In contrast, this type of furnace utilized fluidizable material which may take the form of corrundum of silica particles. One material which becomes fluidized upon being subjected to a flow of gas and which has become popular for such use is sand.

Such furnaces have become known as fluid bed furnaces, and one such furnace is fully described in U.S. Pat. No. 3,884,617, which patent is incorporated herein by reference. The fluid bed furnace there disclosed includes a fluid bed which includes fluidizable material, such as particulate sand. A burner disposed beneath the fluid bed distributes a heated gas mixture to the fluidizable material within the fluid bed for fluidizing and agitating the fluid bed particles. As a result, the heat of the gas mixute is transferred to the fluidizable material and the heat of the fluidizable material is in turn transferred to metallic components placed therein for heat treatment.

Agitation of the fluidized material particles provides for continuous mixing of the particles and continuous particle flow within the fluid bed for obtaining heat from the gas mixture. Fluid bed furnaces have become attractive for heat treating metallic components because the fluidizable material is inert and non-explosive when contacting water. Furthermore, due to the inert nature of the fluidizable material, the fluidizable material does not attack the walls of the container in which it is held. Lastly, the fluidizable material is non-wetting negating the need for treating the heat-treated components for removal of the fluidizable material therefrom.

The burner of the fluid bed furnace is usually provided beneath the fluid bed and is arranged to burn a fuel mixture to provide the flow of gas mixture at an elevated temperature for fluidizing and heating the fluidizable material. In order to ignite such a furnace, the fuel mixture supplied to the burner is allowed to flow through the fluidizable material. Before the supply of fuel mixture is provided to the burner, an ignition flame must be provided above the fluidizable material within the fluid bed. Upon reaching the ignition flame, the fuel mixture will ignite for igniting the burner. After the fuel mixture within the fluidizable material is fully combusted, the burner provides the gas mixture to the fluid bed at an elevated temperature. The flow of the gas mixture fluidizes the fluid bed and the heat of the gas mixture heats the fluidizable material within the fluid bed.

In order to achieve reliable ignition of the fluid bed furnace burner, a flame relatively substantial in length is necessary to be produced in the fluid bed. Furthermore, in order to avoid explosions, the ignition flame must be provided before the fuel mixture is supplied to the burner. Therefore, a pilot light for such a furnace must not only provide an ignition or pilot flame of substantial length within the fluid bed, but furthermore, must include means for sensing the presence of the pilot flame for enabling the supply of fuel mixture to the burner after the detection of the presence of the pilot flame.

It is therefore a general object of the present invention to provide a new and improved fluid bed furnace which includes a new and improved pilot light assembly which provides a pilot flame of substantial expanse within the fluid bed above the fluidizable material and which includes means for sensing the presence of the pilot flame to enable the supply of the fuel mixture to the furnace burner subsequent to such detection.

SUMMARY OF THE INVENTION

The invention provides a pilot light assembly for use in a fluid bed furnace of the type having a fluid bed comprising a material which fluidizes upon being subjected to a flow of a gas mixture therethrough and a burner for burning a fuel mixture for providing the fluidizing gas mixture at an elevated temperature. The pilot light assembly comprises ignition means for providing a pilot flame, pilot flame confining means for directing the pilot flame into the furnace fluid bed above the fluidizable material for causing the pilot flame to ignite the burner fuel mixture, and pilot flame detecting means for sensing the presence of the pilot flame and enabling the supply of the fuel mixture to the burner.

The invention further provides fluid bed furnace including a fluid bed including a material which fluidizes upon being subjected to a flow of a gas mixture therethrough, a burner for burning a fuel mixture for providing the fluidizing gas mixture at an elevated temperature, and a pilot light assembly including an ignition means for providing a pilot flame, pilot flame confining means for directing the pilot flame into the fluid bed above the fluidizable material for causing the pilot flame to ignite the burner fuel mixture, and pilot flame detecting means for sensing the presence of the pilot flame and enabling the supply of the fuel mixture to the burner.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, in the several figures of which like reference numerals identify like elements, and in which:

DESCRIPTION OF THE PREFERRED EMBODIMENT

Figure 1:
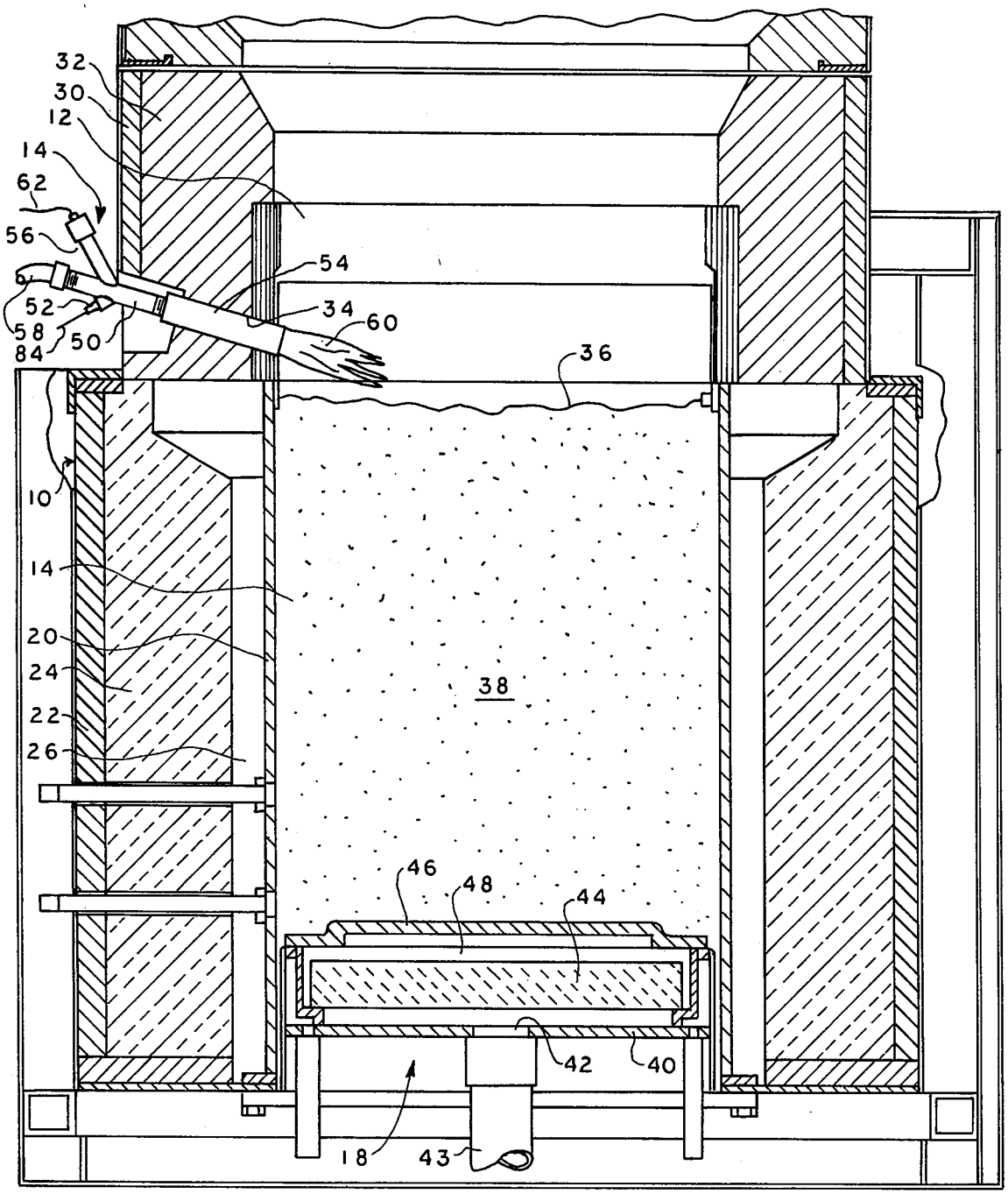
FIG. 1 is a cross-sectional view of a fluid bed furnace embodying the present invention.

Referring now to FIG. 1, the fluid bed furnace there shown generally includes a fluid bed 10 including an upper portion 12 and a lower portion 14, a burner assembly 18, and a pilot light assembly 14 embodying the present invention.

The fluid bed lower portion 14 is cylindrical in configuration and is formed by a pair of co-axially disposed annularly spaced walls 20 and 22. Between the walls 20 and 22 there is provided annular insulation 24 and an annular cooling chamber 26.

The upper fluid bed portion 12 is also generally cylindrical in configuration and includes an outer cylindrical wall portion 30 and insulation 32. Extending through the wall 30 and insulation 32 is a through bore 34 in which the pilot light assembly 14 is disposed for igniting the fluid bed furnace.

Within the lower fluid bed portion 14 is a fluidizable material 38 which may be, for example, particulate sand. The particulate sand is administered to the fluid bed lower portion 14 to a level indicated at 36.

For fluidizing and agitating the sand 38, the burner assembly 18 is provided beneath the fluid bed lower portion 14. The burner assembly includes a bottom plate 40 having a central aperture 42 which communicates with a conduit 43 through which a fuel mixture is administered to the burner assembly. Above the plate 40 is disposed a porous ceramic plate 44 which allows the fuel mixture to pass therethrough. Above the porous ceramic plate is disposed a metallic grid 46 which includes a plurality of tiny through apertures. The through apertures are so small that the particulate sand 38 is not allowed to seep therethrough into the space 48 between the grid 46 and the porous ceramic plate 44.

The pilot light assembly 14 includes an ignition means 50 including a spark plug 52, a pilot flame confining means 54, and a pilot flame detecting means 56. The pilot light assembly 14 is connected to a conduit 58 which provides the pilot light assembly with a fuel mixture. The bore 34 is generally downwardly extending towards the particulate sand 38. The flame confining means 54 confines the pilot flame 60 and directs the pilot flame 60 into the fluid bed over a sufficient expanse above the particulate sand 38 to provide reliable ignition of the burner assembly 18.

The pilot flame detecting means 56 is connected to a relay by a lead 62, which relay upon detection of the pilot flame 60, enables the supply of the fuel mixture to the burner assembly conduit 43. To that end, a valve (not shown) is provided to control the flow of the fuel mixture to the burner assembly which is actuated by the relay connected to the lead 62. Hence, only after the pilot flame 60 is present, will the burner assembly 18 be provided with its fuel mixture through conduit 43.

When igniting the furnace of FIG. 1, the pilot assembly 14 is ignited to provide a pilot flame 60. Then, upon detection of the pilot flame 60, the fuel mixture is supplied to the burner assembly 18 through the conduit 43. The fuel mixture is allowed to pass through the porous ceramic plate 44, the grid 46, and the particulate sand 38 to the vicinity of the pilot flame 60. The fuel mixture is then ignited. After the fuel mixture within the fluid bed has been fully combusted, the flame of the burner assembly 18 will be generally confined between the grid 46 and the porous ceramic tile 44. The burning of the gas fuel by the burner assembly 18 results in the distributed flow of a heated gas mixture through the particulate sand 38. In response to the gas mixture flow, the particulate sand then fluidizes and is agitated for circulation within the fluid bed lower portion 14.

Figure 2:
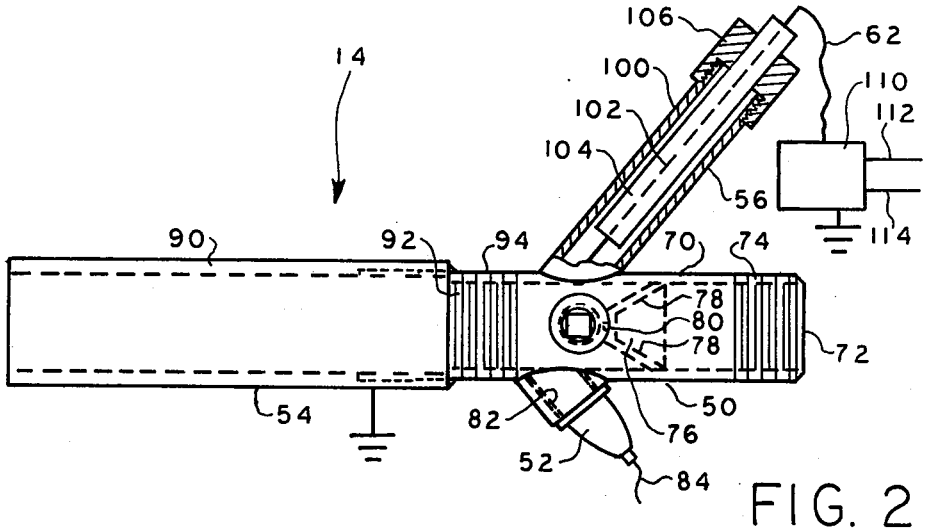
FIG. 2 is a side elevational view, partially in cross-section, of a pilot assembly embodying the present invention.
Figure 3:
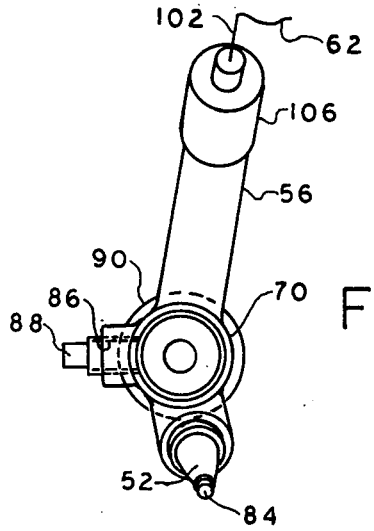
FIG. 3 is an end elevational view of the pilot assembly of FIG. 2.

Now that the improved fluid bed furnace and pilot light assembly has been described in general terms, reference may now be had to FIGS. 2 and 3 wherein the pilot lamp assembly of the present invention is shown in greater detail. The pilot light assembly 14, as previously described, includes an ignition means or portion 50, a pilot flame confining means 54, and a pilot flame detecting means 56.

The ignition means 50 includes a generally tubular housing 70 having an end port 72. About the end port 72 is an external thread 74 which is adapted to be threadingly engaged with a coupling element for connection to the conduit 58 (FIG. 1) which is coupled to a source of fuel mixture for the pilot light assembly 14. The ignition means further includes an orifice structure 76 having a pair of converging side walls 78 which form an orifice 80 therebetween. A spark plug 52 is disposed within a bore 82 and is connected to a suitable voltage source by a lead 84 for igniting the pilot lamp assembly fuel mixture administered at port 72.

The pilot flame confining means 54 comprises a tubular extension 90 which has an internal thread 92 threadingly engaged with an external thread 94 of the tubular housing 70. The extension 90 is axially aligned with the housing 70 and secured thereto by the threaded engagement of the threads 92 and 94. The extension 90 confines the pilot flame therein and, as best seen in FIG. 1 extends through the through bore 34 to direct the pilot flame 60 downwardly towards the particulate sand 38.

The pilot flame detecting means 56 includes a tubular member 100 which communicates with the tubular housing 70 and extends therefrom in a direction away from the extension 90. Within the tubular member 100 is a metallic rod member 102 which projects from the tubular member 100 into the tubular housing 70 in aligned position with the orifice 80 for contacting the pilot flame upon ignition of the pilot light assembly. The rod member 102 is carried within a sleeve 104 which is fixedly mounted within the tubular member 100 by a threaded end cap 106. The rod member 102 extends from the sleeve 104 and is connected to the lead 62 which couples the rod member 102 to a relay 110. The relay has a pair of outputs 112 and 114 which are connected to the valve which controls the supply of fuel mixture to the burner assembly 18. The housing 70 includes a through bore 86 which allows visual inspection therethrough of the position of the rod member 102 within the housing 70. A plug member 88 is provided to plug the bore 86 between visual inspections.

Figure 4:
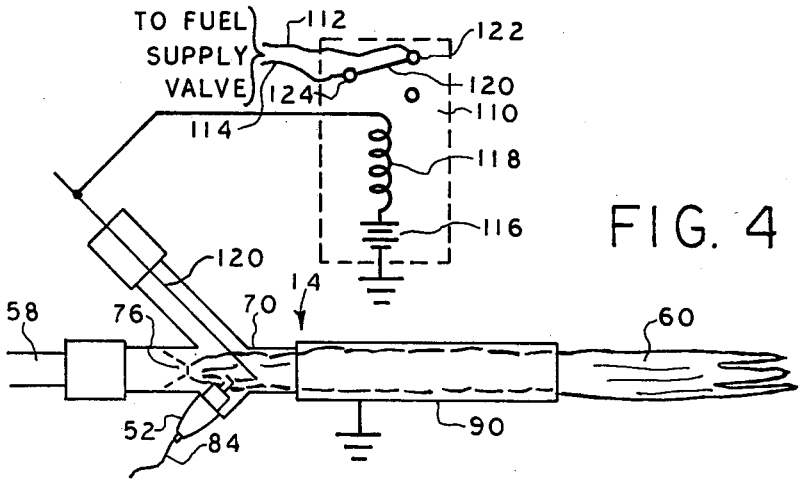
FIG. 4 is a schematic side view of a pilot assembly embodying the present invention in conjunction with a relay means and circuit for sensing the presence of the pilot flame provided by the pilot assembly.

Referring now to FIG. 4, it illustrates the manner in which the pilot flame 60 is detected upon ignition of the pilot lamp assembly 14. As can be seen in the figure, the tubular extension 90 is connected to ground. The relay 110 includes a battery 116, a relay coil 118, and an armature 120 which is controlled by the coil 118. When current flows through the coil 118, as illustrated, the armature 120 will be connected across terminals 122 and 124 which are connected to the leads 112 and 114, for activating the valve which controls the supply of fuel mixture to the burner. The coil 118 is coupled to the rod member 102 which extends into the tubular housing 70 and is disposed therein for contacting the pilot flame 60.

When the pilot light assembly 14 is ignited, a fuel mixture is administered to the tubular housing 70 by the conduit 58. The fuel mixture flows through the orifice structure 76. The spark plug 52 is connected to a suitable voltage source by the lead 84 to cause a spark between its spark gap elements. As a result, the fuel mixture flowing through the orifice structure 76 is caused to ignite forming the pilot flame 60.

Because a burning flame exhibits conductive properties, and because the rod member 102 is disposed within and contacts the pilot flame 60, electrical connection will be established between the rod member 102 and the tubular extension 90 which is grounded. As a result an electrical circuit will be completed from ground, through battery 116, through the relay coil 118, through the rod member 102, and through the pilot flame 60 to ground. When this circuit is established, the pilot flame 60 is thereby detected and the relay coil 118 causes the armature 120 to close so that connection is made across the terminals 122 and 124. The connection across the terminals 122 and 124 provides a control signal over leads 112 and 114 to cause the burner fuel mixture supply valve to open. Hence, the possibility of fuel mixture collecting within the fluid bed prior to the ignition of the pilot assembly is precluded.

From the foregoing, it can be appreciated that the present invention provides a new and improved fluid bed furnace and a new and improved pilot lamp assembly. Because the pilot lamp assembly of the present invention includes means for detecting the presence of the pilot flame for enabling the supply of fuel mixture to the burner, the possibility of explosion within the furnace is precluded. Furthermore, the pilot lamp assembly of the present invention provides a pilot flame having a substantial expanse into the fluid bed above the particulate fluidizable material to provide reliable ignition of the fluid bed furnace.

While a particular embodiment of the present invention has been shown and described, modifications may be made and it is therefore intended to cover in the appended claims all such changes and modifications which fall within the true spirit and scope of the invention.

The invention is claimed as follows:

1. A pilot light assembly for use in a fluid bed furnace of the type having a fluid bed comprising a material which fluidizes upon being subjected to a flow of a gas mixture therethrough and a burner for burning a fuel mixture for providing the fluidizing gas mixture at an elevated temperature, said pilot light assembly comprising: ignition means for providing a pilot flame; pilot flame confining means for directing said pilot flame into the furnace fluid bed above the fluidizable material for causing said pilot flame to ignite the burner fuel mixture; and pilot flame detecting means for sensing the presence of said pilot flame and enabling the supply of fuel mixture to the burner, said ignition means including a tubular housing and said pilot flame confining means comprising a tubular extension mounted to said ignition means tubular housing, said pilot flame detecting means including a rod member projecting into said tubular housing in the path of said pilot flame, said pilot light assembly further comprising a tubular member for supporting said rod member therein, said tubular housing and said tubular extension being axially aligned and said tubular member communicating with and extending from said tubular housing.

2. A pilot light assembly as defined in claim 1 wherein said tubular member extends from said tubular housing in a direction away from said tubular extension.

3. A pilot light assembly as defined in claim 1 wherein said tubular housing includes a radial bore for providing a means for visually inspecting the position of said rod member within said tubular housing.

* * * * *